US006637682B2

(12) United States Patent
Akiyama et al.

(10) Patent No.: US 6,637,682 B2
(45) Date of Patent: Oct. 28, 2003

(54) MECHANICAL CRUSHER

(75) Inventors: Satoshi Akiyama, Saitama (JP); Takanori Morinaka, Saitama (JP); Kenzou Kokubo, Saitama (JP)

(73) Assignee: Nisshin Seifun Group Inc., Tokyo (JP)

( * ) Notice: Subject to any disclaimer, the term of this patent is extended or adjusted under 35 U.S.C. 154(b) by 6 days.

(21) Appl. No.: 09/949,882

(22) Filed: Sep. 12, 2001

(65) Prior Publication Data

US 2002/0005445 A1 Jan. 17, 2002

(30) Foreign Application Priority Data

Sep. 12, 2000 (JP) ..... 2000-276115

(51) Int. Cl.[7] ..... B02C 13/18
(52) U.S. Cl. ..... 241/97; 241/188.1
(58) Field of Search ..... 241/80, 97, 188.1

(56) References Cited

U.S. PATENT DOCUMENTS 3,640,475 A 2/1972 Jung et al.
4,406,409 A * 9/1983 Durek ..... 241/5

FOREIGN PATENT DOCUMENTS

| | | |
|---|---|---|
| DE | 197 15 772 C1 | 7/1998 |
| EP | 0 696 475 A1 | 2/1996 |
| EP | 0 775 526 A1 | 5/1997 |
| JP | 51-64661 | 6/1976 |
| JP | 57-40101 | 9/1982 |

* cited by examiner

*Primary Examiner*—Mark Rosenbaum
(74) *Attorney, Agent, or Firm*—Young & Thompson

(57) ABSTRACT

The mechanical crusher includes a rotating shaft, a rotor mounted about the rotating shaft and having at least one sub-rotor containing a plurality of blades, a liner having a plurality of grooves formed on the inner peripheral surface thereof and disposed externally of the rotor with a predetermined gap defined between the inner peripheral surface thereof and the outer-peripheral surface of the rotor, and a drive unit for rotating the rotor. The blades of at least the one sub-rotor incline in a direction where the flow of a material to be crushed is forced back. With this arrangement, the mechanical crusher can effectively crush a fiber-incluing material such as wheat bran, and the like to fine powder.

10 Claims, 6 Drawing Sheets

MECHANICAL CRUSHER

BACKGROUND OF THE INVENTION

The present invention relates to the technical field of a crusher for crushing a fibrous material and a fiber-containing material such as wheat bran, and the like, and more particularly, to a mechanical crusher capable of finely crushing a fibrous material and a fiber-containing material at a high efficiency.

Mechanical crushers such as the swirl type crusher disclosed in Japanese Examined Utility Model Publication JU. 57-040104 B, the turbo type crusher disclosed in Japanese Unexamined Patent Application Publication JP. 51-064661 A, and the like have been used as an apparatus for crushing a powder-like fiber-containing grain material such as wheat bran to fine powder.

Various types of food that contains fibers are produced and distributed as beauty foods and health foods. At that time, it is preferable that the particle size of fiber-containing fine powder is such that a maximum diameter is 100 $\mu$m or less and an average diameter is 30 $\mu$m or less in order that these foods taste silky.

Further, in fiber-like powder for industrial use, for example, carbon fiber and the like used in a fiber-reinforced composite material, a material having a shorter fiber length is desired to improve mechanical strength by uniformly blending the fiber-like powder with a binder.

In the conventional mechanical crushers as described above, however, the number of revolution of a rotor must be increased to obtain fiber-containing fine powder having the aforementioned particle size with the maximum diameter of 100 $\mu$m or less and the average diameter of 30 $\mu$m or less by crushing a fiber-containing material. Thus, various problems arise in an efficiency of energy, a life of the bearing of the rotor, occurrence of noise and vibration due to the rotation of the rotor at a high speed, and so on.

Moreover, since there is a limit in an increase of the number of revolution of the rotor, powder and/or grains obtained by crushing a fiber-containing material by the conventional mechanical crushers are often mixed with powder which is not crushed to a desired particle size.

Accordingly, to obtain fiber-containing fine powder having a desired particle size, it is necessary to execute a process for removing coarse grains the particle size of which exceeds the desired particle size by means of a classification device such as a sieve, an air classifier, and the like, from which a problem is arisen in that a production efficiency is bad.

SUMMARY OF THE INVENTION

Accordingly, an object of the present invention is to solve the problems of the conventional art and to provide a mechanical crusher for a fiber-containing material capable of effectively crushing a fiber-containing material used for food such as wheat bran and a fiber-like material for industrial use such as carbon fiber and the like to fine powder having a maximum diameter of 100 $\mu$m or less and an average diameter of 30 $\mu$m or less as a particle size.

To achieve the above object, the present invention provides a mechanical crusher comprising a rotating shaft, a rotor mounted about the rotating shaft and having at least one sub-rotor containing a plurality of blades, a liner having a plurality of grooves formed on an inner peripheral surface thereof and disposed externally of the rotor with a predetermined gap defined between the inner peripheral surface thereof and an outer peripheral surface of the rotor, and a drive unit for rotating the rotor and coupled to the rotating shaft, wherein each of the plurality of blades of the at least one sub-rotor incline in a direction where flow of a material to be crushed is forced back.

It is preferable that each of the plurality of blades inclines at an angle of 10° to 45° with respect to an axial direction of the rotating shaft.

It is also preferable that disc-shaped plate members each having a diameter smaller than an outermost diameter of the at least one sub-rotor are disposed so as to clamp the at least one sub-rotor in an axial direction of the rotating shaft.

It is another preferable that the rotor further comprises at least one sub-rotor having a plurality of blades which are rectangular blades provided in a radial direction of the rotor and in parallel to an axial direction of the rotating shaft.

It is further preferable that a pitch of the plurality of blades on the outer peripheral surface of the rotor in a rotational direction of the rotor ranges 8 mm to 40 mm.

It is still another preferable that a size of the plurality of blades in the rotational direction ranges 2 mm to 10 mm and a height of the plurality of blades in a radial direction of the rotor ranges half of the pitch of the plurality of blades to five times the pitch.

To achieve the above object, the present invention provides a mechanical crusher for a fibrous material comprising a rotating shaft, a rotor mounted about the rotating shaft and having at least one sub-rotor containing a plurality of blades, a liner having a plurality of grooves formed on an inner peripheral surface thereof and disposed externally of the rotor with a predetermined gap defined between the inner peripheral surface thereof and an outer peripheral surface of the rotor and a drive unit for rotating the rotor and coupled to the rotating shaft, wherein a pitch of the plurality of blades of at least one sub-rotor of the rotor on the outer peripheral surface of the rotor in a rotational direction of the rotor is set to 8 mm to 40 mm.

It is preferable that the rotor further comprises disc-shaped plate members each having a diameter smaller than an outermost diameter of the at least one sub-rotor and disposed so as to clamp the at least one sub-rotor in an axial direction of the rotating shaft.

It is another preferable that the plurality of blades are rectangular blades provided in a radial direction of the rotor and in parallel to an axial direction of the rotating shaft.

It is further preferable that a size of the plurality of blades in the rotational direction ranges 2 mm to 10 mm and a height of the plurality of blades in a radial direction of the rotor ranges half of the pitch of the plurality of blades to five times the pitch.

DETAILED DESCRIPTION OF THE INVENTION

A mechanical crusher of the present invention used to crush a fiber-containing material will be described in detail with reference to a preferred embodiment shown in the accompanying drawings.

The mechanical crusher of the present invention crushes a fiber-containing material used for food such as wheat bran, and the like and a fiber-like material for industrial use such as carbon fiber, and the like to fine powder.

A fiber-containing material handled by the mechanical crusher of the present invention is not particularly limited, and the mechanical crusher of the invention can crush various types of fiber-containing materials, for example, a fiber-containing material used for food that contains a large amount of dietary fiber that is defined as "the whole difficult-to-digest components contained in food which cannot be broken down by human digestive enzymen", a fiber-like material for industrial use such as various types of inorganic and organic, and so on.

Preferably exemplified as specific examples which are handled by the mechanical crusher of the present invention are fiber-containing materials used for food, for example, wheat bran, been-curd refuse, powdered green tea, dry "wakame", that is, a kind of seaweed (Undaria species), dry "hijiki", that is, a kind of brown algae (Hizikia species), dry layer, dry vegetable, and the like and fiber-like materials for industrial use, for example, various types of fiber such as carbon fiber, acrylic fiber, aramid fiber, nylon fiber, silk, and the like, sawdust (wood powder and chips), pulp, and so on.

It is preferable that the size of these fiber-containing or fiber-like materials used for as the crude materials be 20 mm or less and the water content thereof be 10 wt % or less.

Figure 1:
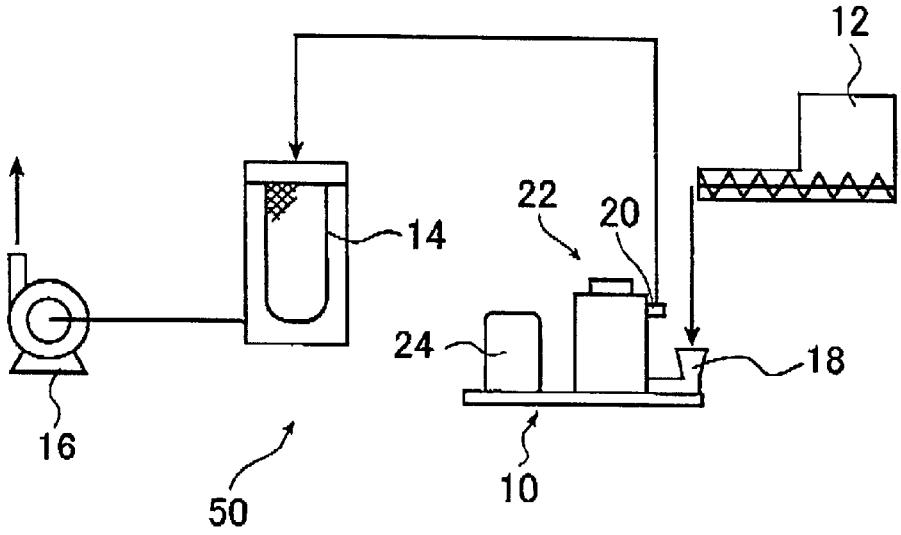
FIG. 1 is a conceptual view showing an embodiment of a crushing apparatus making use of a mechanical crusher of the present invention.

FIG. 1 shows an embodiment of a crushing apparatus for crushing a fiber-containing material making use of a mechanical crusher (hereinafter, simply referred to as "crusher") 10 of the present invention.

The illustrated crushing apparatus 50 includes the crusher 10 of the present invention, a screw feeder 12, a bag filter 14, and a blower 16.

The fiber-containing material to be crushed as the crude material is supplied to the material introduction port 18 of the crusher 10 of the present invention by the screw feeder 12.

Further, the blower 16 is coupled with the discharge port 20 of the crusher 10 through the bug filter 14 so that the interior of the crusher 10 (crusher main body 22) is sucked by the blower 16.

Accordingly, the fiber-containing material supplied to the introduction port 18 by the screw feeder 12 is crushed to fine powder while being transported to the upper portion of the crusher 10 from the introduction port 18 to the discharge port 20 by the air stream formed by the sucking operation of the blower 16 and discharged from the discharge port 20.

The thus discharged fiber-containing fine powder is further transported by the air stream formed by the blower 16 and taken out after it is captured by the bug filter 14.

Figure 2:
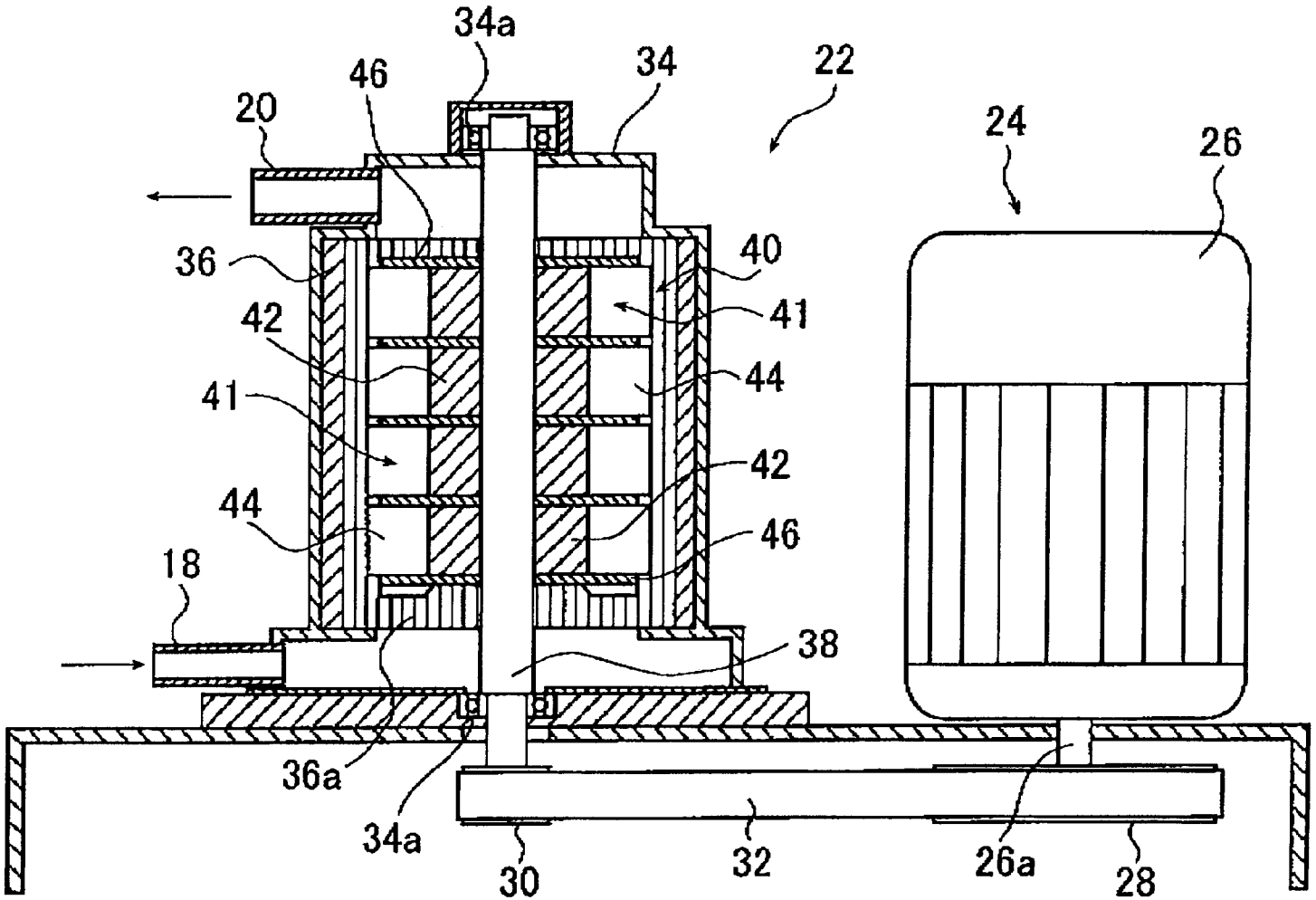
FIG. 2 is a schematic view partly in cross section showing an embodiment of the mechanical crusher of the present invention.

FIG. 2 is a schematic view partially in cross section showing an embodiment of the crusher 10 of the present invention.

The crusher 10 of the present invention is composed of the crusher main body 22 and a rotation device 24.

The rotation device 24 includes a motor 26, a pulley 28 fixed to the shaft 26*a* of the motor 26, a pulley 30 fixed to the lower end of a rotating shaft 38 which will be described later, and an endless transmission belt 32 trained around the pulleys 28 and 30 with tension. The rotation of the motor 26 rotates the rotating shaft 38, therefore, a rotor 40 (rotor assembly of the rotor 40 composed of four sub-rotors 41) which will be described later at a predetermined number of revolution. That is to say, the rotation device 24 functions a drive unit for rotating the rotor 40.

In contrast, the crusher main body 22 is composed of a casing 34 having the introduction port 18 and the discharge port 20 which were described above, a liner 36 disposed on the inner surface of the casing 34, the rotating shaft 38, and the rotor 40 mounted about and fixed to the rotating shaft 38. The rotor 40 may be produced integrally with the rotating shaft 38, or the rotor 40 and the rotating shaft 38 may be produced separately and combined with and fixed to each other.

When necessary, the crusher main body 22 may be cooled by cooling the casing 34 and the like with water.

The liner 36 is formed in a cylindrical shape, has a multiplicity of grooves 36*a* formed on the inner surface thereof, and is disposed in the inside of the casing 34 so as to accommodate the rotor 40 with a predetermined gap defined between the inner peripheral surface (the extreme ends of ribs where the grooves 36*a* are formed) thereof and the outer peripheral surface (the extreme ends of blades 44 to be described later) of the rotor 40. In the invention, the liner 36 may also be a known liner used in various types of mechanical crusher that uses a rotor and a liner.

The shape, pitch, and the like of the grooves 36*a* of the liner 36 are not particularly limited, and a known liner may be selected and used according to the quality of the fiber-containing material, the target particle size of fine powder, and the like. Exemplified as the liner is, for example, a liner including triangular grooves, which have a depth of 4 mm and are formed at a pitch of 6 mm along the rotating direction (the peripheral direction of the inner peripheral surface of the liner) of the rotor 40, and extending in the same direction as the rotating shaft 38 (hereinafter, referred to as an "axial direction").

Further, the gap defined between the inner peripheral surface of the liner 36 and the outer peripheral surface of the rotor 40 is not particularly limited. However, it is preferable to set the gap to about 1 mm to 10 mm because the gap of this size permits a fiber-containing material to be preferably crushed, and permits fine powder having a maximum diameter of 100 $\mu$m or less and an average diameter of 30 $\mu$m or less to be effectively obtained from a fiber-containing material used for food. It is preferable that this gap be uniformly formed between the inner peripheral surface of the liner 36 and the outer peripheral surface of the rotor 40.

The rotating shaft 38 is rotatably journaled between bearings 34*a* and 34*a* disposed on the upper and lower ends of the casing 34. As described above, the pulley 30 of the rotation device 24 is fixed to the lower end of the rotating shaft 38 that is rotated by driving the motor 26. Thus, the rotor 40 fixed to the rotating shaft 38 is rotated when the rotating shaft 38 is rotated through the transmission belt 32 by driving the motor 26.

Figure 3:
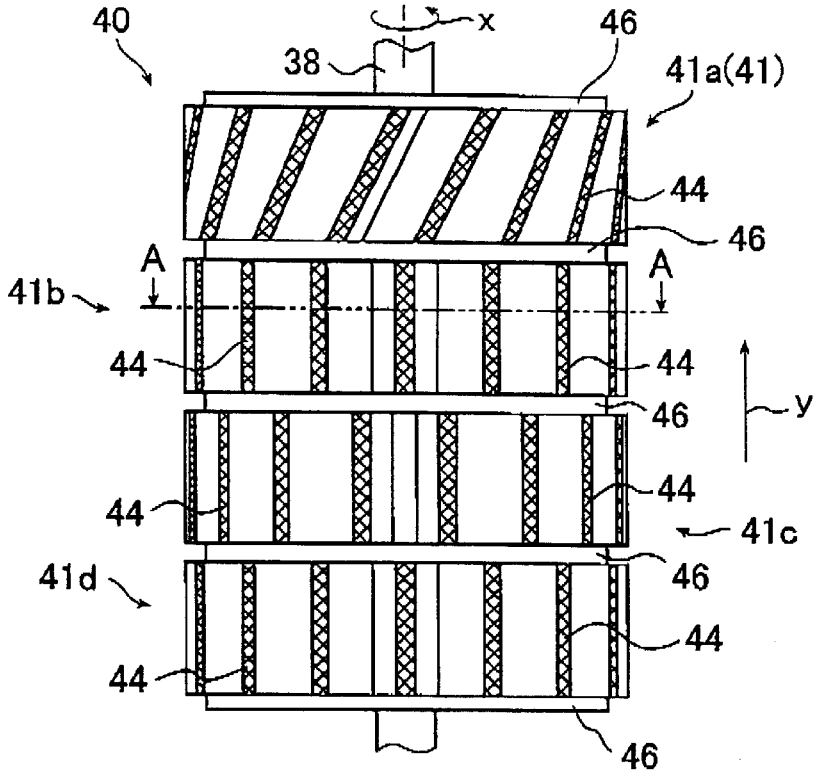
FIG. 3 is a front elevational view of an embodiment of a rotor of the mechanical crusher shown in FIG. 2.
Figure 4:
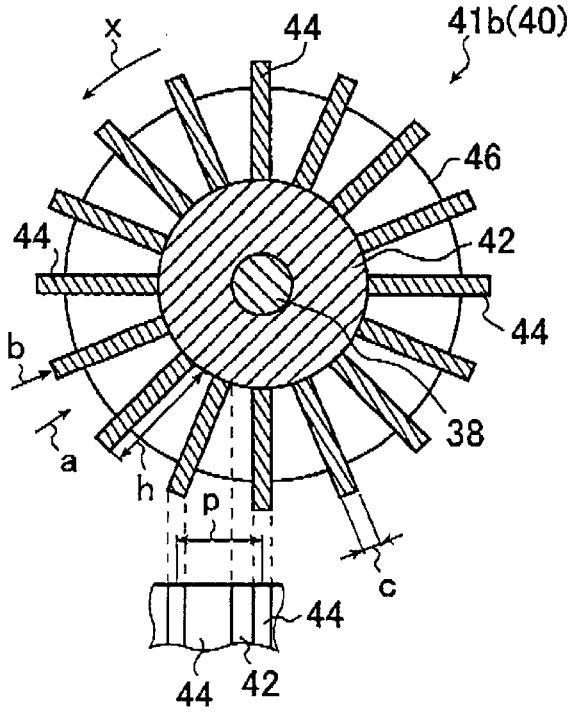
FIG. 4 is a sectional view of the rotor of the mechanical crusher taken along the line A—A of FIG. 3.

FIG. 3 shows a schematic front elevational view of the rotor 40 of the crusher 10 of the first aspect of the present invention, and FIG. 4 shows a schematic sectional view of the rotor 40 taken along the line A—A of FIG. 3, respectively.

The rotor 40 of the crusher 10 is mainly related to the crushing of a fiber-containing material to be crushed.

As shown in FIGS. 3 and 4, the rotor 40 is formed in a cylindrical shape with the center thereof in coincidence with the center of rotation of the rotating shaft 38 and includes a central section 42 fixed to the rotating shaft 38 and the blades 44 that are formed in a rectangular plate shape and project from the outer peripheral surface of the central section 42 in radial directions. These blades 44 are provided in a predetermined number (16 pieces in the exemplified example) at predetermined intervals in a rotational direction (peripheral direction of the central section 42). Note that, in FIG. 3, the extreme end surfaces of the blades 44 are shown with recticulations to make the arrangement thereof distinct.

The rotor 40 also may be arranged by integrally producing the blades 44 and the central section 42, or the rotor 40 may be arranged by separately producing the blades 44 and the central section 42 and combining and fixing them with and to each other.

Note that, in the crusher 10 of the present invention, the sectional shape of the blades 44 is not limited to the rectangular plate shape of the illustrated embodiment shown in FIG. 4, and various types of shape such as a triangular shape, and the like used in known mechanical crushers can be utilized. However, in the present invention, since the fiber-containing material is basically crushed by being impacted and struck with the blades 44 of the rotor 40, it is preferable to form the cross section of the blades 44 in the rectangular plate shape as shown in the illustrated embodiment.

As a preferable aspect of the illustrated crusher 10, a single rotor (the rotor assembly) 40 is arranged by stacking sub-rotors 41*a*, 41*b*, 41*c* and 41*d* in four stages in the axial direction and disposing disc-shaped partitions 46 so as to clamp the sub-rotors 41*a* to 41*d*, which constitute the entire rotor 40, in the axial direction.

Note that the partitions 46 may be produced integrally with the sub-rotors 41*a* to 41*d* of the rotor 40, or the partitions 46 and the sub-rotor 40*a* to 40*d* of the rotor 40 may be separately produced and combined and fixed with and to each other.

Note the rotor may be composed of one sub-rotor or a plurality of sub-rotors. Therefore, in case of the rotor having one sub-rotor, the rotor may be arranged by providing one sub-rotor at the center portion of the rotating shaft in the axial direction and dispusing two disc-shaped partitions at both sides of the subu-rotor in the axial direction. In case of the rotor having a plurality of sub-rotors, the rotor may be arranged by stacking a plurality of sub-rotors and disposing each of the disk-shaped partitions between the adjacent sub-rotors and out sides of both outermost sub-rotors in the axial direction.

In the illustrated embodiment, the uppermost stage sub-rotor 41*a* has the characteristic arrangement of the present invention. That is, the blades 44 of the uppermost stage sub-rotor 41*a* incline in a direction where the flow of a material to be crushed is forced back, while the blades 44 of the other sub-rotors 41*b* to 41*c* are disposed so as to extend in the axial direction.

In the crusher 10 of the present invention, at least one of the sub-rotors 41*a* to 41*d* has the inclining blades 44, which permits the fiber-containing material such as wheat bran and the fiber-like material such as carbon fiber, and the like to be effectively crushed to fine powder.

Figure 5:
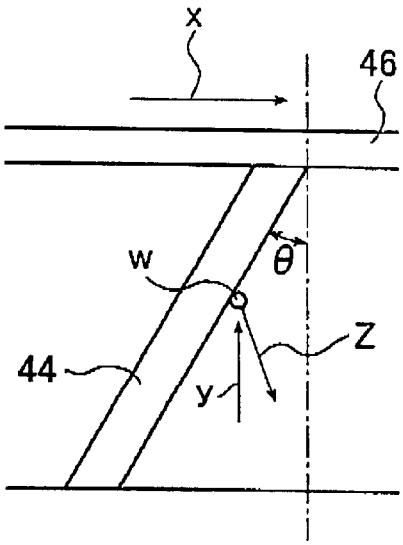
FIG. 5 is a view, partly in enlargement, of the rotor of the mechanical crusher shown in FIG. 3.

FIG. 5 schematically shows the action of the blades 44 that incline in the direction where the material to be crushed is forced back.

Note that, in the present invention, the expression that "the blades of the rotor (sub-rotor) incline in the direction where the material to be crushed is forced back" means that the blades 44 of the rotor 40 (sub-rotor 41) in rotation (in the direction of an arrow x) generate an air stream in a direction opposite to the direction where the material to be crushed (fiber-containing material) w which is supplied into the crusher 10 is transported therein (the direction of an arrow y in the figure)

As shown in FIG. 5, the material to be crushed w is transported in the direction of the arrow y by the air stream generated by the blower 16, collides against the blades 44 of the rotor 40 in rotation, and is crushed thereby.

Grains having a large size are liable to fall into the space (pocket) between the adjacent blades 44 and to collide against the blades 44 because they are unlike to be flown by the air stream In addition to the above-mentioned, after these grains collide against the blades 44, they are forced back upward (direction opposite to the direction where they are transported by the air stream) by the action of the inclining blades 44 as shown by an arrow z. That is, fine grains that have been crushed sufficiently are transported downstream by the air stream generated by the blower 16 and discharged from the crusher 10. In contrast, grains having a large size are forced back by the inclining blades 44, repeat collision against the blades 44, and are subjected to a crushing operation many times until they are sufficiently crushed.

The crusher 10 of the present invention permits the fiber-containing material and the fiber-like material, which cannot be finely crushed by the conventional crusher apparatus effectively, to be crushed to fine powder effectively.

In the crusher 10 of the present invention, the inclining angle of the blades 44 (angle θ shown in FIG. 5) is not particularly limited and the blades 44 may incline at any angle in the above direction in which the material to be crushed is forced back, that is, the inclining angle θ may be set to any angle exceeding 0° and less than 90°. In particular, it is preferable to set the inclining angle to 10° to 45° because fine crushing can be effectively executed at any angle set within the range of these angles.

As described above, in the illustrated crusher 10, the single rotor is constructed by stacking the sub-rotors 41*a* to 41*d* of the four stages in the axial direction through the disc-shaped partitions 46, and the blades 44 of only the uppermost stage sub-rotor 41*a* incline.

In the sub-rotor 41*b* of a second stage (hereinafter, the number of stages is counted from the upper side) to the lowermost stage sub-rotor 41*d*, adjacent sub-rotors are disposed such that the positions of the blades 44 thereof are offset in a rotating direction (direction of an arrow x in FIGS. 3 and 4) each other. That is, in FIG. 3, a third stage sub-rotor shows a state in which the rotor 40 is viewed in the direction of an arrow a in FIG. 4, and a second stage sub-rotor and a lowermost stage sub-rotor show a state in which the rotor 40 is viewed from the direction of an arrow b in FIG. 4.

As described above, the rotor 40 is composed of at least two stages of the sub-rotors and further the positions of the blades 44 are offset in the rotating direction in stages of the rotors adjacent to each other in the axial direction, whereby the fiber-containing material and the fiber-like material can be crushed more preferably.

Note that when the crusher 10 is constructed by the rotor 40 including a plurality of stages, the number of the stages is not particularly limited.

Further, when the rotor 40 has a plurality of stages of sub-rotors as shown in the illustrated embodiment, the respective sub-rotors 41*a* to 41*d* (and the partitions 46) may be produced integrally, or the sub-rotors and the partitions may be produced separately and combined with and fixed to each other.

As described above later, however, it is possible in the crusher of the present invention to combine various types of sub-rotors. Accordingly, it is preferable to combine sub-rotors produced separately and to combine and fix them with and to each other to cope with a variation of the combinations thereof.

As a preferable aspect of the illustrated crusher 10, the partitions 46 are disposed so as to clamp the respective sub-rotors 41*a* to 41*d* in the axial direction. While the partitions 46 are not essential in the present invention, the provision of them can more improve the crushing efficiency of the fiber-containing material and the fiber-like material.

Note that the size of the partitions 46 is not particularly limited. According to the examination of the inventors, however, it is preferable that the size of the partitions 46 be slightly smaller than the outermost diameter (the extreme end of the blades 44) of the rotor 40. In particular, it is preferable that the size of the partitions 46 he smaller than the outermost diameter of the rotor 40 by 2 mm to 40 mm in radius.

The illustrated crusher 10 has the rotor 40 composed of the sub-rotors 41*a* to 41*d* of the four stages, and the blades 44 of only the uppermost stage sub-rotor 41*a* incline in the direction where the flow of the material to be crushed is forced back (hereinafter, simply referred to as "incline") However, the combination of the sub-rotors in the crusher of the present invention is not limited thereto and various combinations are possible as described above.

Figure 6A:
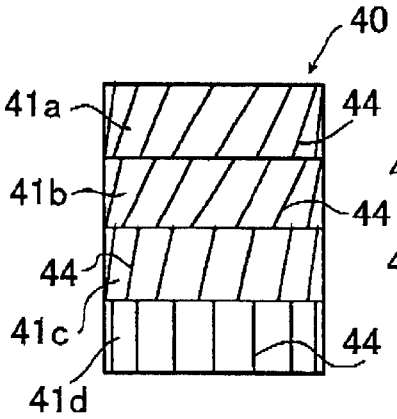
FIGS. 6(A), (B) and (C) are conceptual views showing other embodiments of the rotor used in the mechanical crusher of the present invention.

For example, as schematically shown in FIG. 6A, sub-rotors 41*a* and 41*b* having blades 44 that incline similarly may be used in uppermost and second stages, respectively, a sub-rotor 41*c* having blades 44 that incline at a small angle may be used in a third stage, and a sub-rotor 41*d* having blades 44 without inclination may be used in a lowermost stage.

Figure 6B:
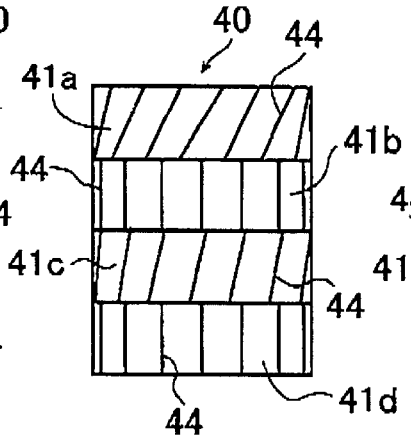

Otherwise, as shown in FIG. 6B, a sub-rotor 41*a* having blades 44 that incline at a large angle may be used in an uppermost stage, a sub-rotor 41*c* having blades 44 that incline at a small angle may be used in a third stage, and sub-rotors 41*b* and 41*d* having blades 44 without inclination may be used in second and lowermost stages respectively.

Figure 6C:
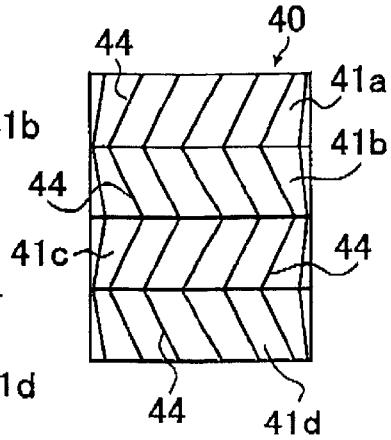

Further, as shown in FIG. 6C, sub-rotors 41*b* and 41*d* having blades 44 that incline in a direction opposite to the direction where the flow of the material to be crushed is forced back may be combined with sub-rotors 41*a* and 41*c* having blades 44 that incline in the direction where the flow of the material to be crushed is forced back.

In the present invention, sub-rotors 41*a* to 41*d* having blades 44 that incline similarly may be used in all the stages, sub-rotors 41*a* to 41*d* having blades 44 that incline at a different angle may be used in all the stages, and a sub-rotor 41*d* having inclining blades 44 may be used only in the lowermost stages in addition to the above arrangements. That is, the present invention can use various combinations of sub-rotors 41.

Further, while all of the above examples have the four-stage sub-rotors, the present invention is by no means limited thereto as described above.

In the sub-rotors 41 of the crusher 10 of the present invention, the pitch P of the blades 44 on the outer peripheral surface thereof, the thickness c of the blades 44, and the height h of the blades 44 (length of the central section 42 in a radial direction) are not particularly limited and may be suitably determined according to the scale and the like of the crusher 10, regardless of whether the blades 44 of the sub-rotors incline or not.

According to the examination of the inventors, as descirbed above, it is preferable that the pitch P of the blades 44 be set to 8 mm to 40 mm, that the thickness c of the blades 44 be set to 2 mm to 10 mm, and that the height h of the blades 44 be set to half of the pitch P of the blades 44 to five times the pitch 2, more preferably one to five times the pitch P of the blades 44, respectively.

Satisfying at least one or all of the above conditions permits the fiber-containing material and the fiber-like material to be crushed more preferably and more excellent fine powder of fiber to be obtained.

A method of producing the sub-rotors 41 and the rotor 40 is not particularly limited and any known method such as cutting and the like can be used. Further, after the rotor 40 is produced, the hardness of the surface thereof may be improved by a method such as induction hardening, thermal spraying, CVD coating, or the like.

Further, a material for forming the rotor 40 is not particularly limited, and a steel material such as SS, S45C, etc., for example, may be used.

In the crusher 10 of the present invention having the rotor 40 arranged as described above, the rotational speed of the rotor 40 is not particularly limited.

However, it is preferable to set such a rotational speed that the peripheral speed of the rotor 40 is set to 60 m/sec to 160 m/sec, in particular 80 m/sec to 140 m/sec on the outer peripheral surface thereof in order to execute crushing excellently.

Figure 7:
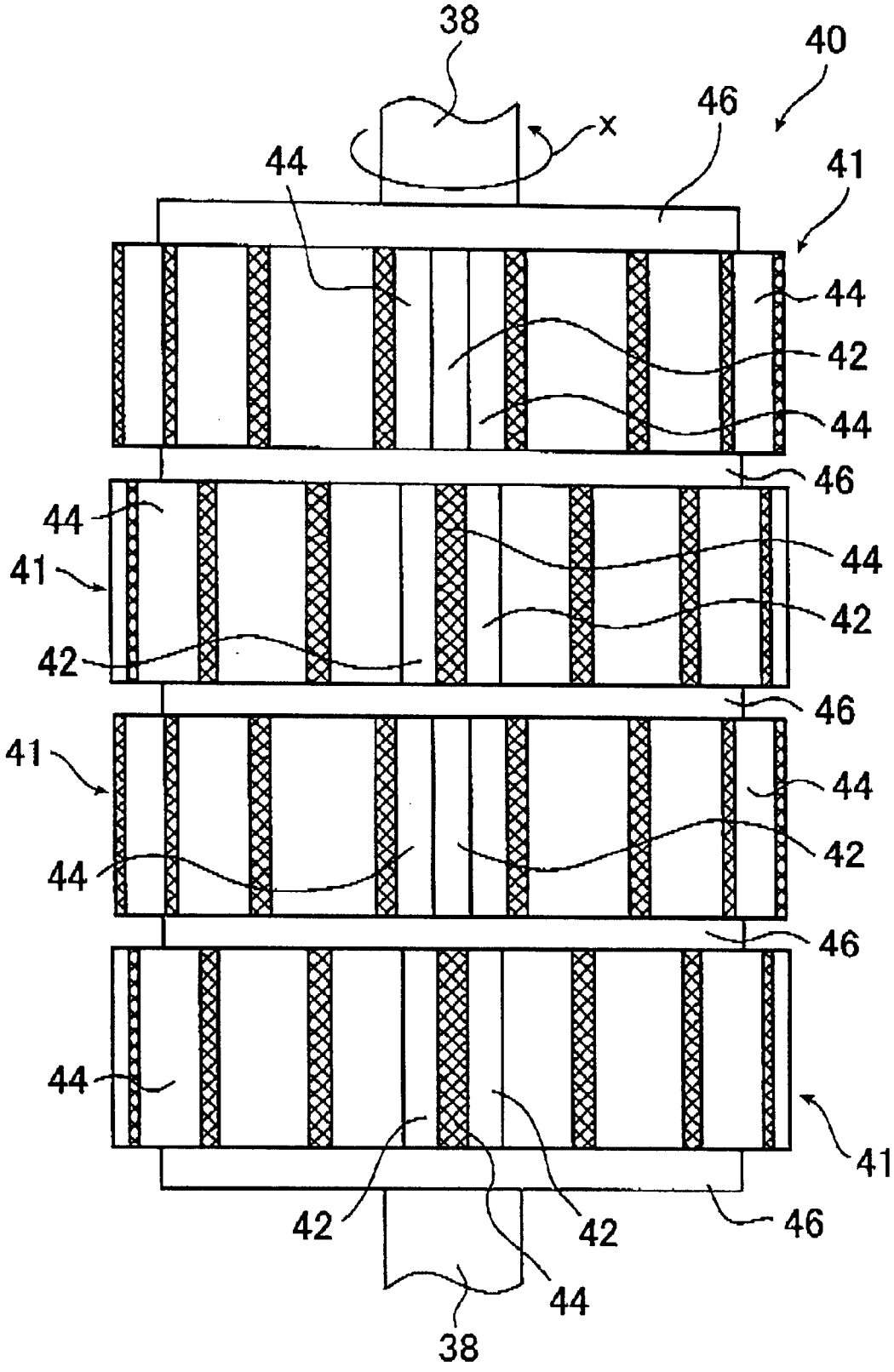
FIG. 7 is a schematic front elevational view showing another embodiment of the rotor of the mechanical crusher shown in FIG. 2.

Furthermore, in the rotor 40 of the crusher 10 of the present invention, as shown in FIG. 7, a plurality of blades 44 of the sub-rotors 41 in all the stages may be blades in the rectangular plate shape which have no inclination, that is to say, which extend from the center section 42 of the rotor 40 in radial directions and are positioned longitudinally in parallel with the axial direction of the rotating shaft 38. It should be noted that FIG. 4 may be also accounted a sectional view of the second stage sub-rotor 41 of the rotor 40 shown in FIG. 7.

Also in the rotor 40 shown in FIG. 7, adjacent sub-rotors 41 are disposed such that the positions of the blades 44 thereof are offset in a rotating direction (direction of an arrow x in FIGS. 7 and 4) each other, as is the case with the rotor 40 shown in FIG. 3. That is, in FIG. 7, an uppermost stage and a third stage show a state in which the sub-rotors 41 are viewed in the direction of an arrow a in FIG. 4, and a second stage and a lowermost stage in FIG. 7 show a state in which the sub-rotors 41 are viewed from the direction of an arrow b in FIG. 4. In this case also, the rotor 40 is composed of at least two stages of the sub-rotors 41 and the positions of the blades 44 are offset in the rotating direction in stages adjacent to each other in the axial direction, whereby the fiber material such as the fiber-containing material and the fiber-like material can be crushed more preferably.

When the rotor 40 shown in FIG. 7 is used, it is required that the blades 44 of each of sub-rotors 41 as stated above be arranged such that the pitch P shown in FIG. 4, which is the pitch of the blades 44 in the rotating direction on the outer peripheral surface of the sub-rotor 41 (pitch of the extreme ends of the blades 44), is 8 mm to 40 mm, preferably 10 mm to 30 mm.

As mentioned before, when a fiber material such as a fiber-containing material and a fiber-like material is to be crushed to fine powder having a particle size of 100 $\mu$m or less by any conventional mechanical crusher, it is necessary, for example, to increase the number of revolution of the rotor 40 and a problem of low efficiency occurs because crushing can not be effected desirably with such crushers.

In contrast, according to the present invention, it is possible to crush a fiber material such as wheat bran to fine powder having a particle size of 100 $\mu$m or less by setting the pitch P of the blades 44 on the outer peripheral surface of the rotor (hereinafter referred to as "blade pitch P") to 8 mm to 40 mm. The fine powder thus obtained can be suitably added to various foods.

As will be evident from the Example 7 stated below, if the blade pitch P is larger than 40 mm, the efficiency in crushing of a fiber material is decreased and fine powder of fiber crushed to a particle size of 100 $\mu$m or less can not be obtained at a high efficiency.

On the other hand, the crushing efficiency is again decreased with the blade pitch P which is too small. If the blade pitch P is smaller than 8 mm, fine powder of fiber crushed to a particle size of 100 $\mu$m or less can also not be obtained at a high efficiency.

Also in the rotor 40 shown in FIG. 7, the thickness c (the size in the rotating direction) of the blades 44 is not particularly limited and is preferably 2 mm to 10 mm.

The height h (the length in a radial direction of the center section 42) of the blades 44 of this rotor 40 is also not particularly limited. It is preferably half of the blade pitch P to five times the blade pitch P, more preferably one to five times the blade pitch P.

Satisfying one, or both espetially, of above two conditions permits the fiber-containing material and the fiber-like material to be crushed more preferably and more excellent fine powder of fiber to be obtained.

In the examples as described above, the rotating shaft 38 is arranged vertically, although the present invention is not limited to such an arrangement. The rotating shaft 38 may also be arranged horizontally, for example.

While the mechanical crusher of the present invention has been described above in detail, the present invention is by no means limited to the aforementioned embodiments and it goes without saying that various improvements and modifications can be made within the range which does not depart from the gist of the present invention.

EXAMPLES

The present invention will be described in more detail by exemplifying specific examples of crushing carried out by the mechanical crushers of the present invention. It is needless to say that the present invention is not limited thereto.

Example 1

A crusher 10 of the first aspect of the present invention was produced which was arranged such that a rotor 40 shown in FIG. 3, had a diameter (extreme end of blades 44) of 150 mm, the gap between the rotor 40 and a liner 36 was set to 2 mm, the height h of the blades 44 was set to 20 mm, the thickness c of the blades 44 was set to 6 mm, the number of the blades 44 was set to 16 pieces, the height of a single sub-rotor 41 was set to 45 mm, the number of stages of the sub-rotors 41 of the rotor 40 was set to four states, the diameter of partitions 46 was set to 136 mm, and the thickness of the partitions 46 was set to 5 mm. The crusher apparatus 50 shown in FIG. 1 was constructed using the crusher 10 and wheat bran having a particle size of about 2 mm was crushed thereby.

Wheat bran was supplied through a screw feeder 12 in an amount of 1 kg/hr. Further, the number of revolution of the rotor 40 was set to 10,000 rpm to 14,000 rpm, and the volume of air supplied from a blower 16 was set to 2 $m^3$/min.

Under the above conditions, wheat bran was crushed by replacing the uppermost stage sub-rotor 41*a* of the crusher 10 with three types of sub-rotors 41 the inclining angle θ of the blades 44 of which was set to 0°, 15°, and 30°, respectively. Note that the inclining angle of the blades 44 of the sub-rotors 41*b*, 41*c* and 41*d* of the stages other than the uppermost stage was set to 0°.

Figure 8:
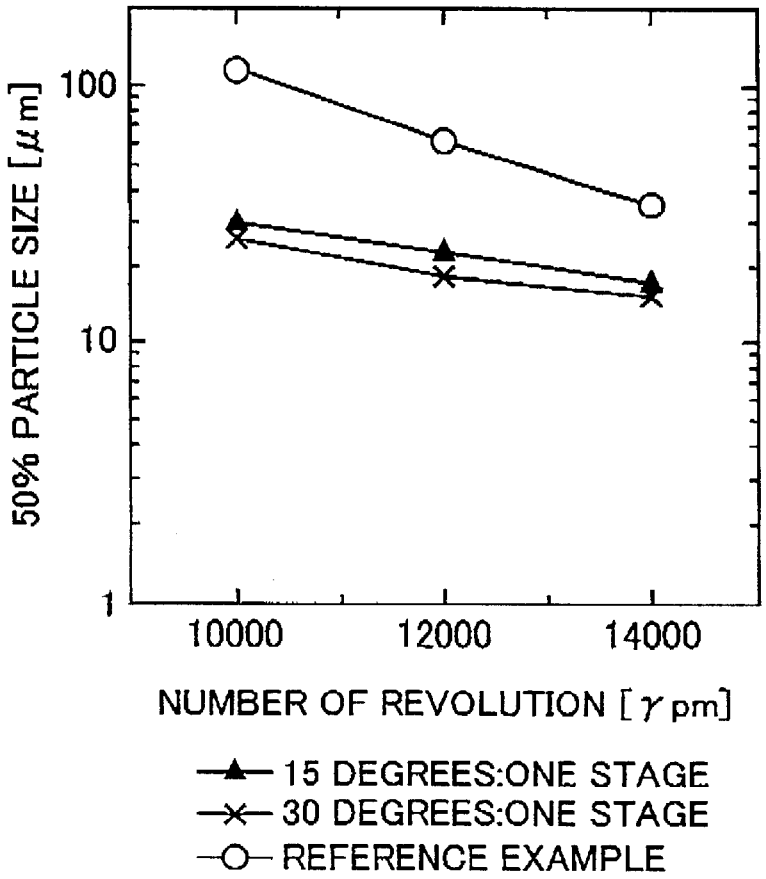
FIG. 8 is a graph showing a 50% particle size when wheat bran is crushed in this example.

The 50% particle size of the wheat bran having been crushed was measured with a dry type laser particle size measuring instrument (Microtrack), and FIG. 8 is a graph showing the result of measurement.

In FIG. 8, a symbol ○ indicates the result of measurement when the sub-rotor 41*a* the blades 44 of which had the inclining angle θ set to 0° was used, a symbol ▲ indicates the result of measurement when the sub-rotor 41*a* the blades 44 of which had the inclining angle θ set to 15° was used, and a symbol X indicates the result of measurement when the sub-rotor 41*a* the blades 44 of which had the inclining angle θ set to 30° was used, respectively. As apparent from the graph, the crusher of the present invention could crash wheat bran more finely as compared with the case in which wheat bran was crushed with the crusher of the second aspect of the present invention as the reference example when the wheat bran was crushed under the same conditions, and further the number of revolution of the rotor of the crusher of the first aspect of the present invention could be greatly reduced when the same particle size was obtained in crushing, whereby the crushing capability of the crusher of the first aspect of the present invention could be greatly improved.

Example 2

A crusher 10 was constructed similarly to the Example 1 except that the inclining angle θ of the blades 44 of uppermost stage and second stage sub-rotors 41*a* and 41*b* was set to 30° and that the inclining angle θ of the blades 44 of a third stage sub-rotor 40*c* was set to 15° as shown in FIG. 6A. Wheat bran was crushed using the crusher 10 similarly to the Example 1 except that the number of revolution of a rotor 40 was fixed to 14,000 rpm.

When the 50% particle size of the wheat bran having been crushed was measured similarly to the Example 1, it was 9.5 $\mu$m, whereby it was confirmed that the wheat bran could be crushed greatly finely as compared with the case in which wheat bran was crushed with the crusher as the Example 1 and the reference example.

Example 3

A crusher 10 was constructed similarly to the Example 1 except that the pitch P of the blades 44 of second stage to lowermost stage sub-rotors 41*b* to 41*d* was set to one half that the blades 44 of the Example 1 and that the number of the blades 44 was set to 32 pieces. Wheat bran was crushed using the crusher 10 similarly to the Example 1 except that the number of revolution of a rotor 40 was fixed to 10,000 rpm.

When the 50% particle size of the wheat bran having been crushed was measured similarly to the Example 1, it was 26 μm, whereby it was confirmed that the wheat bran could be crushed greatly finely as compared with the case in which wheat bran was crushed with the crusher as the reference example.

Example 4

A crusher 10 was constructed similarly to the Example 1 except that the inclining angle θ of the blades 44 of an uppermost stage sub-rotor 41*a* was set to 30° and the inclining angle θ of the blades 44 of a third stage sub-rotor 41*c* was set to 15° as shown in FIG. 6B. Wheat bran was crushed using the crusher 10 similarly to the Example 1 except that the number of revolution of a rotor 40 was fixed to 14,000 rpm.

When the 50% particle size of the wheat bran having been crushed was measured similarly to the Example 1, it was 17.6 μm, whereby it was confirmed that the wheat bran could be crushed greatly finely as compared with the case in which wheat bran was crushed with the crusher as the reference example.

Example 5

A crusher 10 was constructed similarly to the Example 1 except that the inclining angle θ of the blades 44 of an uppermost stage sub-rotor 41*a* was set to 30°, the inclining angle θ of the blades 44 of a second stage sub-rotor 41*b* was set to −30°, the inclining angle θ of the blades 44 of a third stage sub-rotor 41*c* was set to 30°, and the inclining angle θ of the blades 44 of a lowermost stage sub-rotor 41*d* was set to −30° as shown in FIG. 6C. Wheat bran was crushed using the crusher 10 similarly to the Example 1 except that the number of revolution of a rotor 40 was fixed to 14,000 rpm.

When the 50% particle size of the wheat bran having been crushed was measured similarly to the Example 1, it was 21.6 μm, whereby it was confirmed that the wheat bran could be crushed greatly finely as compared with the case in which wheat bran was crushed with the crusher as the reference example.

Example 6

Polyamide resin having a fiber length of about 0.2 mm was crushed with a crusher apparatus 50 similarly to the Example 3 (that is, using the same crusher 10 as the Example 3). The polyamide was supplied through a screw feeder 12 in an amount of 0.3 kg/hr, the number of revolution of a rotor 40 was set to 14,000 rpm, and the amount of air supplied from a blower 16 was set to 2 $m^3$/min.

When the 50% particle size of a resulting crushed product was measured with a wet type laser particle size measuring instrument (Microtrack), it was 24 μm. When polyamide resin was crushed using the crusher of the reference example of in the Example 1 under the same conditions, the 50% particle size of a resulting crushed product was 48 μm, whereby it was confirmed that the polyamide resin could be crushed greatly finely as compared with the case in which polyamide resin was crushed with the crusher as the reference example.

Example 7

In the crusher apparatus 50 shown in FIG. 1, wheat bran was crushed varying the blade pitch P of respective sub-rotors 41 of the rotor 40 in the crusher main body 22 as shown in FIG. 7.

In the rotor 40 (sub-rotors 41) used, the rotor diameter (the maximum diameter as measured to the extreme ends of blades 44) was 150 mm, as well as the height h of the blades 44 was 40 mm, their thickness c was 6 mm and their size in the axial direction was 50 mm. In the case of the rotor with the blade pitch P of about 6 mm, the thickness c of the blades 44 was changed into 4 mm and their height h into 8 mm for reasons of production and arrangement. In the crusher main body 22, four stages of sub-rotors 41 were stacked to a single rotor 40, as shown in FIG. 7.

As the liner 36 was used a liner including triangular grooves 36*a* of a 4 mm depth extending in the axial direction, which were formed in the inner peripheral surface of the liner 36 at a pitch of 6 mm along the rotating direction.

Using the crusher apparatus 50 comprising such components as above, wheat bran having a particle size of about 2 mm, which was supplied through the screw feeder 12 at a rate of 5 kg/hr, was crushed under suction by the blower 16 at an air flow rate of 1.5 $m^3$/min.

Figure 9:
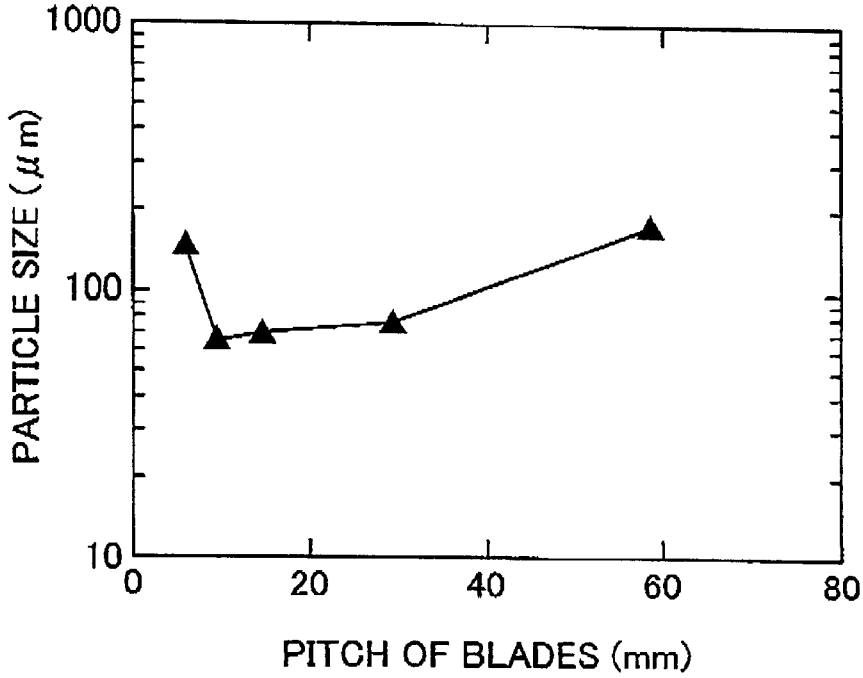
FIG. 9 is a graph showing the relationship between the pitch of the blade and the cumulative 90% minus sieve particle size in the example of the present invention.

FIG. 9 shows the relationship between the blade pitch P and the cumulative 90% minus sieve particle size (the particle size in which the cumulative size distribution (the under size distribution) is 90%) when the number of revolution of the rotor 40 was set to 14,000 rpm (corresponding to an air velocity of 109.9 m/sec).

As seen from FIG. 9, according to the present crusher 10, wherein the blade pitch P is 8 mm to 40 mm, it is possible to crush wheat bran suitably to obtain fine powder having a particle size of 100 μm or less at a high efficiency.

Figure 10:
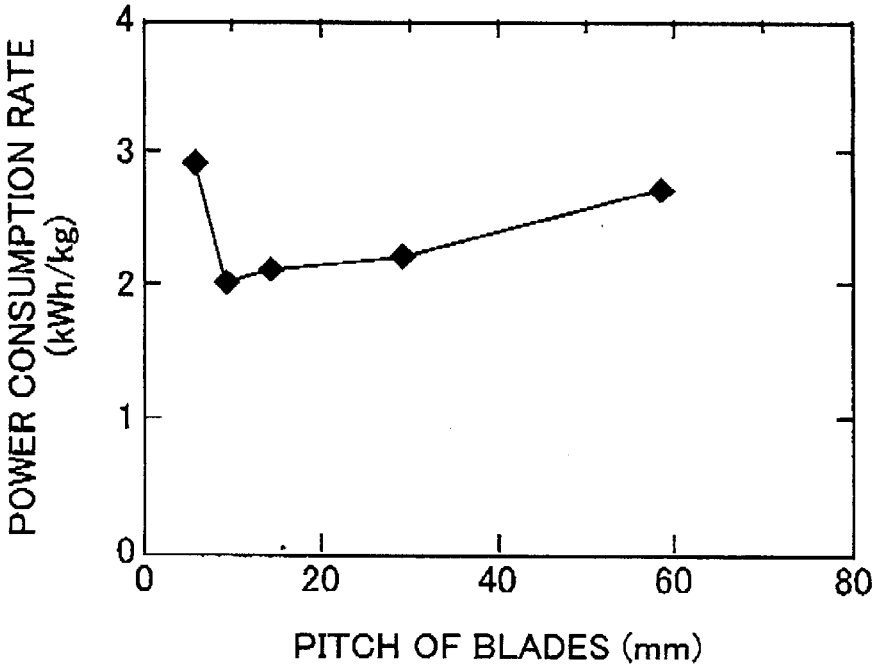
FIG. 10 is a graph showing the relationship between the pitch of the blade and the power consumption rate in the example of the present invention.

Further, FIG. 10 shows the relationship between the blade pitch P and the power required for crushing a material of a unit weight (power consumption rate) when the number of revolution of the rotor 40 was adjusted such that the crushed product had the cumulative 50% minus sieve particle size of 20 μm.

As seen from FIG. 10, according to the present crusher 10, wherein the blade pitch P is 8 mm to 40 mm, it is possible to finely crush wheat bran with an energy efficiency higher than ever.

The advantage of the present invention will be apparent from the above results.

As described above in detail, according to the mechanical crusher of the present invention, fiber materials including a fiber-containing material used for food such as wheat bran and the like and a fiber-like material for industrial use such as carbon fiber and the like can be more finely crushed at a high efficiency, making it possible to obtain fine powder of fiber having a particle size of 100 μm or less at a high efficiency, for example.

Consequently, if the present invention is applied to foods, for example, those health foods and beauty foods can be desirably produced which contain fine powder of fiber and yet have pleasant feels in the mouth, as testing silky or being smooth on the tongue, for example.

What is claimed is:

1. A mechanical crusher comprising:

a rotating shaft;

a rotor mounted about said rotating shaft and having at least one sub-rotor containing a plurality of blades;

a liner having a plurality of grooves formed on an inner peripheral surface thereof and disposed externally of said rotor with a predetermined gap defined between the inner peripheral surface thereof and an outer peripheral surface of said rotor; and a drive unit for rotating said rotor and coupled to said rotating shaft, wherein each of said plurality of blades of said at least one sub-rotor inclines with respect to an axial direction of said rotating shaft such that a flow of a material to be crushed is forced back.

2. The mechanical crusher according to claim 1, wherein each of said plurality of blades inclines at an angle of 10° to 45° with respect to the axial direction of said rotating shaft.

3. The mechanical crusher according to claim 1, wherein disc-shaped plate members each having a diameter smaller than an outermost diameter of said at least one sub-rotor are disposed so as to clamp said at least one sub-rotor in the axial direction of said rotating shaft.

4. The mechanical crusher according to claim 1, wherein said rotor further comprises at least one sub-rotor having a plurality of blades which are rectangular blades provided in a radial direction of said rotor and in parallel to the axial direction of said rotating shaft.

5. The mechanical crusher according to claim 1, wherein a pitch of said plurality of blades on said outer peripheral surface of said rotor in a rotational direction of said rotor ranges 8 mm to 40 mm.

6. The mechanical crusher according to claim 5, wherein a size of said plurality of blades in the rotational direction ranges 2 mm to 10 mm and a height of said plurality of blades in a radial direction of said rotor ranges half of the pitch of said plurality of blades to five times the pitch.

7. A mechanical crusher for a fibrous material comprising:

a rotating shaft;

a rotor mounted about said rotating shaft and having at least one sub-rotor containing a plurality of blades;

a liner having a plurality of grooves formed on an inner peripheral surface thereof and disposed externally of said rotor with a predetermined gap defined between the inner peripheral surface thereof and an outer peripheral surface of said rotor; and a drive unit for rotating said rotor and coupled to said rotating shaft, wherein a pitch of said plurality of blades of at least one sub-rotor of said rotor on said outer peripheral surface of said rotor in a rotational direction of said rotor is set to 8 mm to 40 mm.

8. The mechanical crusher according to claim 7, wherein said rotor further comprises disc-shaped plate members each having a diameter smaller than an outermost diameter of said at least one sub-rotor and disposed so as to clamp said at least one sub-rotor in an axial direction of said rotating shaft.

9. The mechanical crusher according to claim 7, wherein said plurality of blades are rectangular blades provided in a radial direction of said rotor and in parallel to an axial direction of said rotating shaft.

10. The mechanical crusher according to claim 7, wherein a size of said plurality of blades in the rotational direction ranges 2 mm to 10 mm and a height of said plurality of blades in a radial direction of said rotor ranges half of the pitch of said plurality of blades to five times the pitch.

* * * * *